US010019976B1

(12) United States Patent
Tanaka

(10) Patent No.: US 10,019,976 B1
(45) Date of Patent: Jul. 10, 2018

(54) ELECTRONIC PERCUSSION

(71) Applicant: ATV corporation, Hamamatsu-shi, Shizuoka (JP)

(72) Inventor: Tsutomu Tanaka, Shizuoka (JP)

(73) Assignee: ATV corporation, Shizuoka (JP)

( * ) Notice: Subject to any disclaimer, the term of this patent is extended or adjusted under 35 U.S.C. 154(b) by 0 days.

(21) Appl. No.: 15/864,560

(22) Filed: Jan. 8, 2018

(30) Foreign Application Priority Data

Jan. 10, 2017 (JP) ..... 2017-001606

(51) Int. Cl.
*G10H 1/32* (2006.01)
*G10H 3/14* (2006.01)

(52) U.S. Cl.
CPC ..... *G10H 1/32* (2013.01); *G10H 3/146* (2013.01); *G10H 2220/525* (2013.01)

(58) Field of Classification Search
CPC ..... G10H 1/32; G10H 3/146; G10H 2220/525
USPC ..... 84/730
See application file for complete search history.

(56) References Cited

U.S. PATENT DOCUMENTS 4,669,349 A * 6/1987 Hyakutake ..... G10D 13/024 84/730
4,800,795 A * 1/1989 Yamashita ..... G10D 13/024 248/288.31
5,293,000 A * 3/1994 Adinolfi ..... G10D 13/024 84/730
5,856,628 A * 1/1999 Noguchi ..... G10H 3/146 84/421
6,576,829 B1 * 6/2003 Hart ..... G10H 3/146 84/104
2003/0061932 A1 * 4/2003 Tanaka ..... G10H 3/146 84/734
2004/0118269 A1 * 6/2004 Yoshino ..... G10H 3/146 84/723
2013/0152765 A1 * 6/2013 Morita ..... G10D 13/02 84/413

(Continued)

FOREIGN PATENT DOCUMENTS

JP H10031482 A 2/1998
JP 2010224330 A 10/2010

OTHER PUBLICATIONS

Decision of Grant mailed on Aug. 8, 2017 for the corresponding Japanese Patent Application No. 2017-001606.

*Primary Examiner* — David Warren
*Assistant Examiner* — Christina Schreiber
(74) *Attorney, Agent, or Firm* — Rankin, Hill & Clark LLP

(57) ABSTRACT

An electronic percussion includes: a plate-shaped head constituting a struck surface beaten by a player; a frame formed into an annular frame shape surrounding an outer edge of the head, the frame holding the head via the outer edge; and a hitting sensor configured to detect at least one of a vibration and a pressure generated by hitting of the head to output an electrical signal. The frame includes: a first holding groove formed into a groove shape at an inner surface of the frame, the outer edge of the head being engaged with the first holding groove such that the head is held; and a second holding groove formed into a groove shape at a position adjacent to and along the first holding groove such that the second holding groove communicates with the first holding groove, the second holding groove having a depth deeper than a depth of the first holding groove.

18 Claims, 5 Drawing Sheets

(56) References Cited

U.S. PATENT DOCUMENTS

| | | | | |
|---|---|---|---|---|
| 2013/0180388 | A1* | 7/2013 | Mori | G10H 3/14 84/723 |
| 2014/0260920 | A1* | 9/2014 | Kanayama | G10H 3/146 84/730 |
| 2014/0260921 | A1* | 9/2014 | Kanayama | G10H 3/146 84/730 |
| 2015/0082967 | A1* | 3/2015 | Yoshino | G10D 13/022 84/411 M |
| 2017/0236505 | A1* | 8/2017 | Takasaki | G10D 13/024 84/723 |

* cited by examiner

ELECTRONIC PERCUSSION

CROSS-REFERENCE TO RELATED APPLICATION

This application claims priority from Japanese Patent Application No. 2017-001606 filed with the Japan Patent Office on Jan. 10, 2017, the entire content of which is hereby incorporated by reference.

BACKGROUND

1. Technical Field

This disclosure relates to an electronic percussion.

2. Description of the Related Art

Generally, there has been provided an electronic percussion that detects an impact to a struck surface beaten by a hand, a stick, or the like to generate an electronic musical sound. For example, an electronic drum (an electronic percussion) disclosed in JP-A-2010-224330 includes a drum head (a head), which constitutes a struck surface beaten by a hand or the like, made of a thin plate member assumed to have rigidity. This head is fixed to a bottom case (a frame) by fastening screws.

SUMMARY

An electronic percussion includes: a plate-shaped head constituting a struck surface beaten by a player; a frame formed into an annular frame shape surrounding an outer edge of the head, the frame holding the head via the outer edge; and a hitting sensor configured to detect at least one of a vibration and a pressure generated by hitting of the head to output an electrical signal. The frame includes: a first holding groove formed into a groove shape at an inner surface of the frame, the outer edge of the head being engaged with the first holding groove such that the head is held; and a second holding groove formed into a groove shape at a position adjacent to and along the first holding groove such that the second holding groove communicates with the first holding groove, the second holding groove having a depth deeper than a depth of the first holding groove.

DESCRIPTION OF THE EMBODIMENTS

Figure 1:
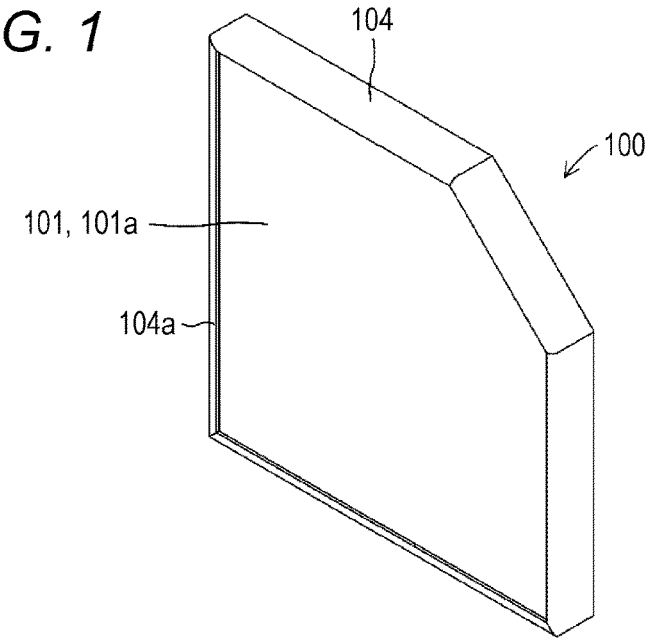
FIG. 1 is a perspective view illustrating an outline of an external configuration on a front side of an electronic percussion according to one embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

With the electronic drum type electronic percussion disclosed in JP-A-2010-224330, the drum head as the head is fixed to the bottom case as the frame by fastening the screws. This makes a shape, a structure, and a mechanism of the drum head complicated. Furthermore, this makes an attachment work of the drum head to the bottom case and a work to remove the drum head from the bottom case during maintenance complicated.

One object of this disclosure is to provide the following electronic percussion. With this electronic percussion, a head with rigidity can be easily configured. Furthermore, the head can be easily mounted to/removed from a frame that supports the head.

An electronic percussion according to one aspect of the present disclosure (the present electronic percussion) includes: a plate-shaped head constituting a struck surface beaten by a player; a frame formed into an annular frame shape surrounding an outer edge of the head, the frame holding the head via the outer edge; and a hitting sensor configured to detect at least one of a vibration and a pressure generated by hitting of the head to output an electrical signal. The frame includes: a first holding groove formed into a groove shape at an inner surface of the frame, the outer edge of the head being engaged with the first holding groove such that the head is held; and a second holding groove formed into a groove shape at a position adjacent to and along the first holding groove such that the second holding groove communicates with the first holding groove, the second holding groove having a depth deeper than a depth of the first holding groove.

The electronic percussion includes the groove-shaped first holding groove and the groove-shaped second holding groove at the inner surface of the frame. The outer edge of the head is inserted into the first holding groove. Thus, the first holding groove holds the head. The second holding groove is communicated with the first holding groove and has the depth deeper than the depth of the first holding groove. Therefore, with the electronic percussion, the head having rigidity can be formed into a simple plate shape. Furthermore, this ensures easily mounting the head to the first holding groove via the second holding groove or easily removing the head.

The present electronic percussion may further include a head fixing body engaged with the second holding groove to press the outer edge of the head disposed inside the first holding groove.

According to this aspect, the present electronic percussion includes the head fixing body made of an elastic body in the second holding groove. Therefore, the head engaged with the inside of the first holding groove is pressed by the head fixing body. This ensures efficiently restraining a drop of the head from the inside of the first holding groove.

With the present electronic percussion, the first holding groove may be formed to have a thickness thinner than a thickness of the outer edge of the head.

According to this aspect, the first holding groove is formed to have the thickness (a groove width) thinner than the thickness of the outer edge of the head. Therefore, the second holding groove side of the head projects out to the inside of the second holding groove and is pressed to the head fixing body. This allows the electronic percussion to hold the head further stably.

With the present electronic percussion, the first holding groove may be formed adjacent to at least one end among both ends of the inner surface of the frame. The second holding groove may be formed with respect to the first holding groove on a side opposite to the one end in the inner surface of the frame.

According to this aspect, the first holding groove is formed adjacent to at least the one end of the inner surface of the frame. Furthermore, the second holding groove is formed with respect to the first holding groove on the side opposite to the one end. Therefore, the head can be disposed close to the end of the frame. This facilitates hitting the head. Furthermore, togetherness in appearance between the head and the frame can be enhanced.

With the present electronic percussion, the frame may be formed such that the one end adjacent to the first holding groove decreases in thickness to an inside of the annular frame.

According to this aspect, the one end of the frame adjacent to the first holding groove is formed so as to decrease in thickness to the inside of the annular frame. Therefore, the end of the frame elastically supports the outer edge of the head vibrating by hitting. Consequently, an unusual sound between both can be restrained.

The present electronic percussion may further include a buffer made of an elastic body disposed between the head and the frame in the first holding groove.

According to this aspect, the buffer made of the elastic body is disposed between the head and the frame in the first holding groove. This restrains a direct contact of the outer edge of the head, which vibrates by hitting, to an inner wall surface of the first holding groove, thereby ensuring restraining the unusual sound between both.

Figure 2:
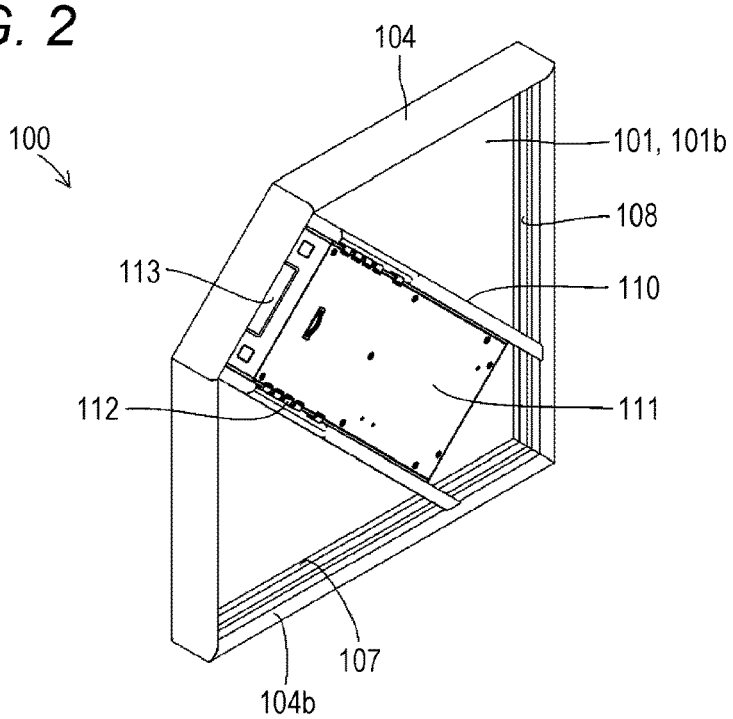
FIG. 2 is a perspective view illustrating an outline of an external configuration on a back side of the electronic percussion illustrated in FIG. 1.
Figure 3:
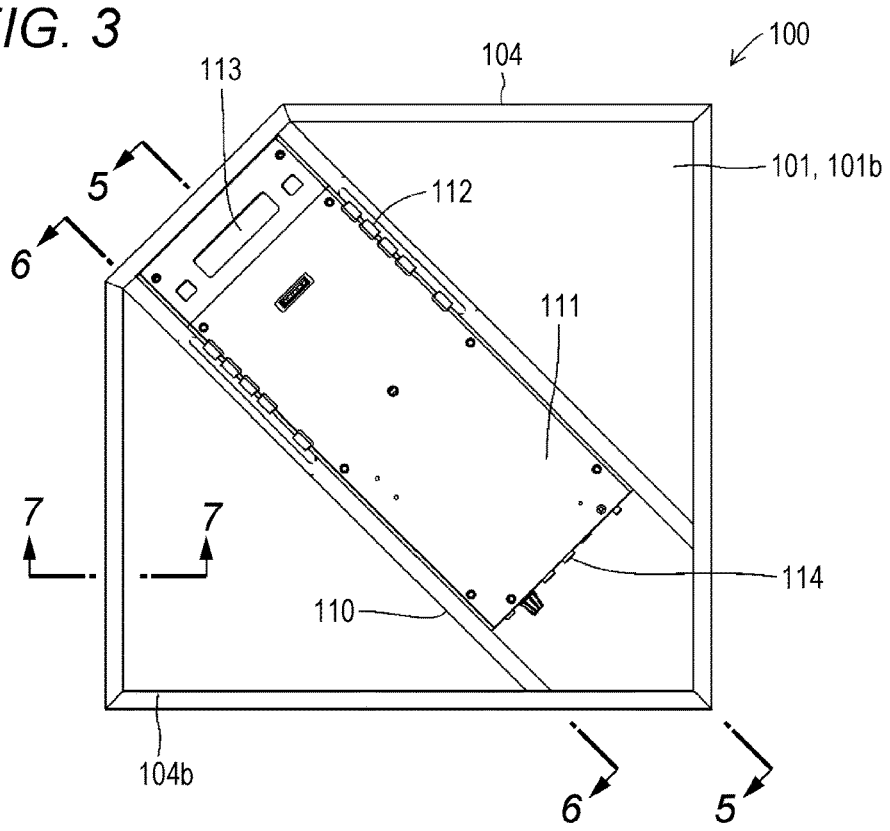
FIG. 3 is a bottom view illustrating the outline of the external configuration on the back side of the electronic percussion illustrated in FIG. 1.

The following describes one embodiment of the electronic percussion according to this disclosure with reference to the drawings. FIG. 1 is a perspective view illustrating an outline of an external configuration on a front side of an electronic percussion 100 according to the embodiment. FIG. 2 is a perspective view illustrating an outline of an external configuration on a back side of the electronic percussion 100 illustrated in FIG. 1. FIG. 3 is a bottom view illustrating the outline of the external configuration on the back side of the electronic percussion 100 illustrated in FIG. 1.

The drawings to be referred in this description are schematically illustrated for ease of understanding of the technique of this disclosure by exaggeratedly illustrating a part of components and the like. Therefore, dimensions, ratios, and the like between the respective components may differ between the actual components and the illustrated components.

This electronic percussion 100 is an electronic musical instrument that detects an impact to a struck surface 101*a* beaten by a hand (or a stick) of a player (not illustrated) to generate an electronic musical sound.

(Configuration of Electronic Percussion 100)

Figure 4:
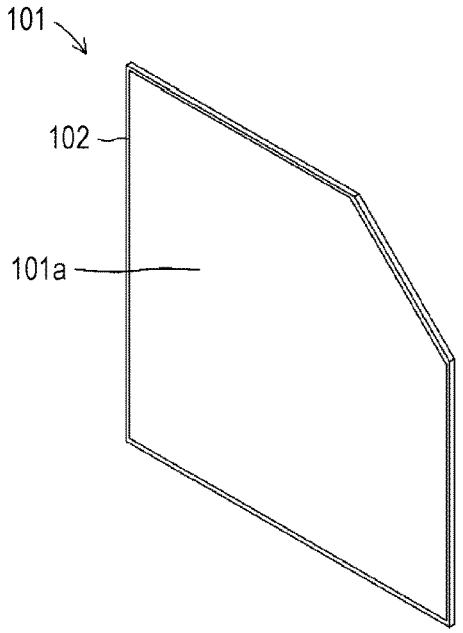
FIG. 4 is a perspective view illustrating an outline of an external configuration of a head provided with the electronic percussion illustrated in FIG. 1.

The electronic percussion 100 includes a head 101. The head 101 is a component that vibrates and elastically deforms by a beating operation or a rubbing operation by the player. The head 101 is made of a plate-shaped flexible rigid body. More specifically, as illustrated in FIG. 4, the head 101 is configured by forming a semitransparent plate-shaped resin material (for example, an acrylic resin material) into a deformed pentagon (a shape chamfering one corner of a square shape) in plan view. With this embodiment, the head 101 is formed to have a thickness of 2 mm and a length of 360 mm in a longitudinal direction and a lateral direction.

The material and the shape of the head 101 are not limited to the material and the shape shown in the embodiment. As the material of the head 101, a material other than a resin material (transparent, semitransparent, or nontransparent) (for example, a metal material or wood) may be employed. The head 101 may be formed to have a shape other than "the deformed pentagon" (for example, a polygon such as a regular pentagon, a quadrangle, a triangle, or a hexagon, a circular shape, an oval shape, or various deformed shapes).

This head 101 has one surface as the struck surface 101*a*. The struck surface 101*a* is a part beaten and rubbed by the hand of the player or the stick and formed into a planar shape. In this case, the struck surface 101*a* may be configured as a smooth surface. However, in this embodiment, the struck surface 101*a* has unevenness to the extent that the player can obtain a rough touch when stroking the struck surface 101*a* by the palm of the hand or the fingertip. A buffer 102 is disposed on an outer edge on the struck surface 101*a* side of the head 101.

The buffer 102 is a component to restrain a friction and the unusual sound generated when a plate surface of the head 101 directly contacts the inner wall surface of the first holding groove, which will be described later, in the first holding groove. The buffer 102 is made of an elastic body or a soft fabric. With this embodiment, the buffer 102 is made of a nonwoven fabric extending in a thin strip shape. This buffer 102 is fixedly secured on the head 101 with an adhesive double coated tape or an adhesive (not illustrated).

Figure 5:
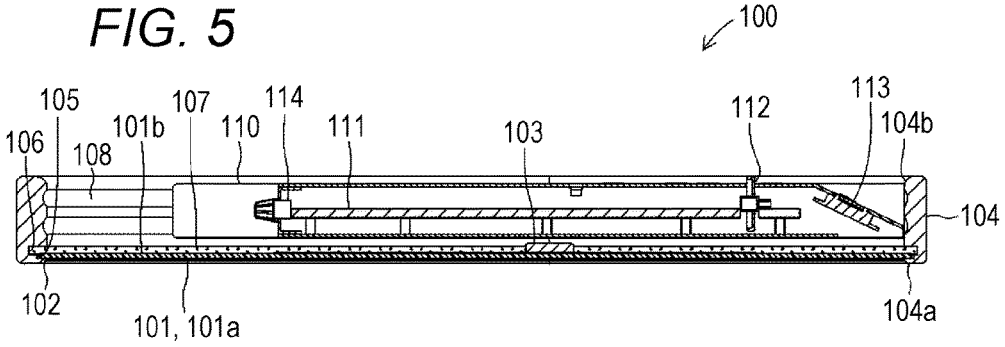
FIG. 5 is a cross-sectional view illustrating an outline of an inner configuration of the electronic percussion viewed from line 5-5 illustrated in FIG. 3.

Meanwhile, as illustrated in FIG. 5, a back surface 101*b*, which is the other surface of the head 101, of the struck surface 101*a* is formed into a smooth planar shape. A hitting sensor 103 is disposed at the center of this back surface 101*b*.

The hitting sensor 103 is a detector that detects the vibrations of the head 101. The hitting sensor 103 outputs electrical signals according to the vibrations of the head 101 to a sound source 111. The hitting sensor 103 of this embodiment includes a piezo element. This hitting sensor 103 is fixedly secured to the center of the back surface 101*b* of the head 101 with an adhesive double coated tape, an adhesive, or the like (not illustrated). In this case, the center of the head 101 is an approximate center part of the head 101 in plan view and therefore does not strictly mean only the center position. This hitting sensor 103 is electrically connected to the sound source 111 via a signal line (not illustrated).

Figure 6:
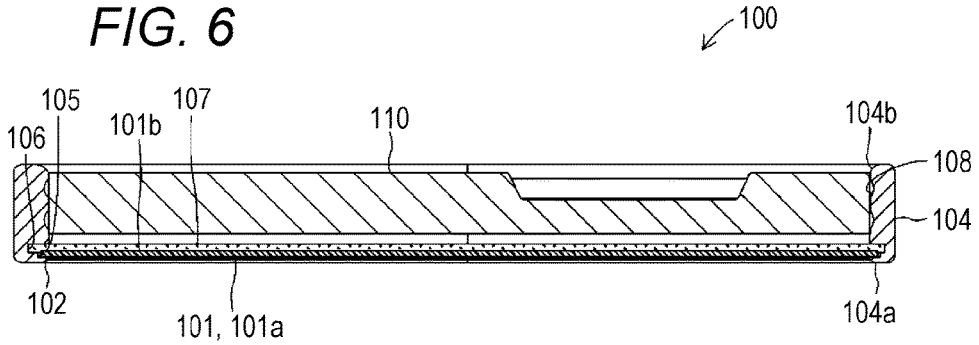
FIG. 6 is a cross-sectional view illustrating an outline of an inner configuration of the electronic percussion viewed from line 6-6 illustrated in FIG. 3.
Figure 7:
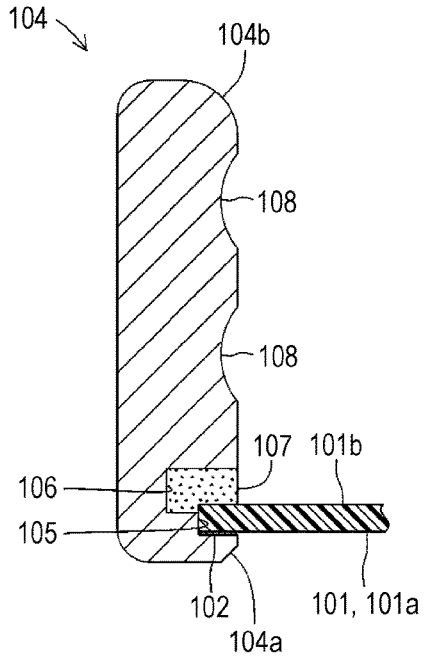
FIG. 7 is a cross-sectional view illustrating an outline of an internal configuration of a frame in the electronic percussion viewed from line 7-7 illustrated in FIG. 3.

The outer edge of the head 101 is supported by a frame 104. That is, the frame 104 supports the head 101 via the outer edge of the head 101. As illustrated in FIG. 5 to FIG. 7, the frame 104 is a component that supports the head 101 and the sound source 111. The frame 104 is an annular framing body corresponding to the outer edge of the head 101. That is, the frame 104 is formed into the annular frame surrounding the outer edge of the head 101. More specifically, the frame 104 is configured by shaping a plate-shaped wood into a deformed pentagon corresponding to the shape of the outer edge of the head 101. In this case, the frame 104 is formed such that the size of the inner surface of the frame 104 in plan view becomes smaller than the size of the head 101 in plan view. With the frame 104, the plate-shaped wood (the plate-shaped body) has a thickness with which at least a second holding groove 106, which will be described later, can be formed. Furthermore, the height of the plate-shaped body (a length in a direction perpendicular to the plate surface of the head 101) is formed (set) to a height such that that the player can grip the frame 104 by one hand.

With the frame 104 of this embodiment, the plate-shaped body constituting respective sides of the pentagon is laminated woods of bamboo. The respective sides of the plate-shaped body adjacent to one another are mutually fixedly secured with the adhesive. The frame 104 has the longitudinal and lateral lengths of 380 mm, the thickness of 11 mm, and the height of 44 mm. The frame 104 can be made of a material other than the wood, for example, a resin material or a metal material.

A first holding groove 105, the second holding groove 106, and handholds 108 are formed at the inner surface of this frame 104. The first holding groove 105 is a part to which the outer edge of the head 101 fits. That is, the first holding groove 105 is formed into a groove shape at the inner surface of the frame 104. The first holding groove 105 is configured such that the outer edge of the head 101 is engaged with the first holding groove 105 to hold the head 101.

The first holding groove 105 has a groove shape depressed into a square and annularly extends along a circumferential direction of the inner surface of the frame 104. In this case, the first holding groove 105 has a depth such that the shape (the deformed pentagon) formed by the first holding groove 105 becomes slightly larger than the outer shape of the head 101. Furthermore, the first holding groove 105 is formed to have a thickness (a groove width) thinner than the thickness of the outer edge of the head 101.

The first holding groove 105 is formed on one end 104*a* side among both ends of the frame 104 in the height direction so as to be adjacent to the one end 104*a*. In this case, the one end 104*a* in the frame 104 is a part facing the plate surface of the head 101. The one end 104*a* is formed to decrease in thickness to the distal end part. That is, the frame 104 has the one end 104*a* adjacent to the first holding groove 105 formed to decrease in thickness to the inside of the annular frame 104.

The second holding groove 106 is a part used to dispose the head 101 in the first holding groove 105. The second holding groove 106 has a groove shape depressed into a square. The second holding groove 106 is formed at a position adjacent to the first holding groove 105 along the first holding groove 105 so as to communicate with the first holding groove 105. The second holding groove 106 annularly extends along the circumferential direction of the inner surface of the frame 104. In this case, the second holding groove 106 has a groove shape with a depth deeper than a depth of the first holding groove 105. Furthermore, the second holding groove 106 has a thickness (a groove width) thicker than the outer edge of the head 101. This second holding groove 106 internally includes a head fixing body 107.

The head fixing body 107 is a component to restrain a drop of the head 101 disposed in the first holding groove 105 from the inside of the first holding groove 105. The head fixing body 107 is made of an elastic body engaged with the inside of the second holding groove 106. The head fixing body 107 is engaged with the second holding groove 106 to press the outer edge of the head 101 disposed in the first holding groove 105. More specifically, the head fixing body 107 is made of a resin material with elasticity and flexibility (for example, a urethane resin material or a rubber material) by which the head fixing body 107 freely bends. The head fixing body 107 is configured by forming this resin material so as to have a cross-sectional shape larger than a cross-sectional shape of the second holding groove 106 and have a string shape extending along the second holding groove 106. That is, this embodiment forms the head fixing body 107 as the five string-shaped members having a square cross-sectional shape, having the length corresponding to the length of the respective sides of the frame 104, and linearly extending.

The handholds 108 are parts to which the hand is put when the player grips the frame 104 during performance. The handholds 108 are two grooves depressed into an arc shape. The two handholds 108 both annularly extend along the circumferential direction of the inner surface of the frame 104. These handholds 108 are formed at a region from the center in the height direction of the inner surface of the frame 104 to another end portion 104*b*. The count and the depth of the groove-shaped handholds 108 are appropriately settable and are not limited to the count and the depth shown in the embodiment.

The frame 104 internally includes the sound source 111 via sound source support frames 110. The sound source support frames 110 are components to support the sound source 111 at the inner region of the frame 104. The sound source support frames 110 are configured by arranging and bridging two plate materials made of the material identical to the frame 104 along a diagonal direction of the frame 104.

The sound source 111 includes a metal housing and a microcomputer provided in this housing, the microcomputer including, a CPU, a ROM, a RAM, and the like. The sound source 111 is an electronic circuit that outputs musical sound signals based on detection signals output from the hitting sensor 103. More specifically, the sound source 111 executes a control program preliminary stored in a storage device such as the ROM to generate the musical sound signals representing the musical sound based on the detection signals output from the hitting sensor 103.

This sound source 111 includes an operation switch 112 to input an instruction from the player, a display device 113, which is constituted of a liquid crystal panel to display an operating state of the sound source 111, and an output terminal 114 to take out the musical sound signal. The operation switch 112, the display device 113, and the output terminal 114 are disposed in the sound source 111 exposed to the outer surface of the housing. Accordingly, the electronic percussion 100 can generate the musical sound according to the preference of the player by the instruction from the player. Furthermore, an electrical connection of the output terminal 114 to an external speaker (not illustrated) allows generating the musical sound from the external speaker.

This electronic percussion 100 includes a power supply with a power supply cord (not illustrated), which introduces electric power from a household power source to supply the electric power to the sound source 111. Since not directly related to the actions and effects of the embodiment, the explanation is omitted. In this embodiment, the electronic percussion 100 is configured to be a so-called external type that externally couples the speaker generating the musical sound. However, the electronic percussion 100 can be configured to be a built-in type including a speaker to generate the musical sound in the frame 104.

(Manufacturing of Electronic Percussion 100)

Figure 8:
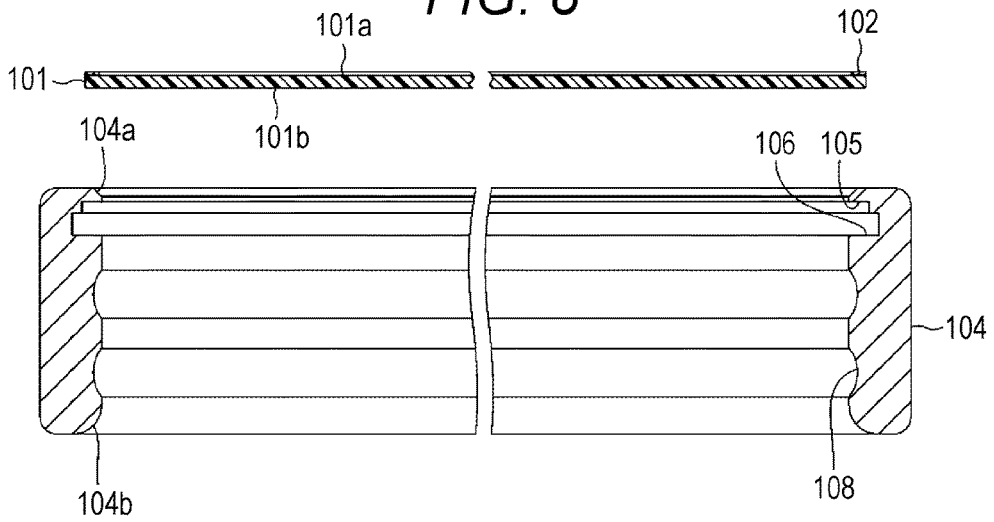
FIG. 8 is a cross-sectional view schematically illustrating one process of a work process to mount the head to the frame in manufacturing of the electronic percussion illustrated in FIG. 1.

The following describes a manufacturing process of the electronic percussion 100 configured as described above. As illustrated in FIG. 8, first, a worker who manufactures the electronic percussion 100 prepares the head 101 and the frame 104. In this case, the buffer 102 is pasted to the outer edge on the struck surface 101*a* side of the head 101. The first holding groove 105, the second holding groove 106, and the handholds 108 are formed at the frame 104 together with the sound source support frames 110.

Figure 9:
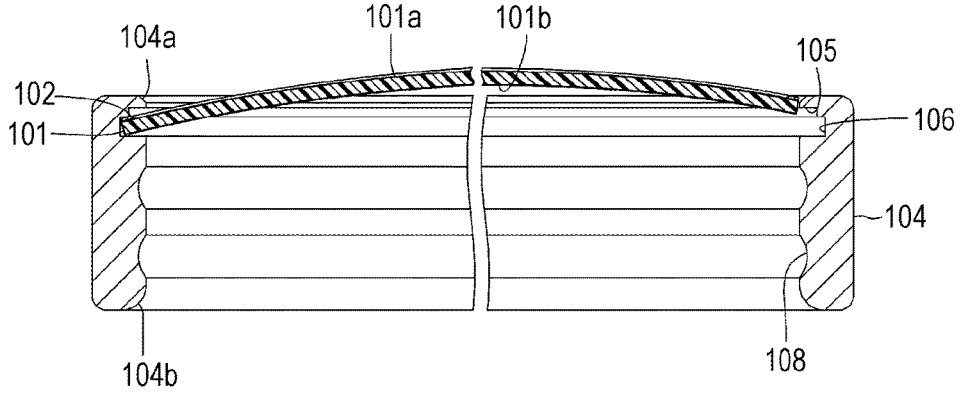
FIG. 9 is a cross-sectional view schematically illustrating another one process of the work process to mount the head to the frame in the manufacturing of the electronic percussion illustrated in FIG. 1.
Figure 10:
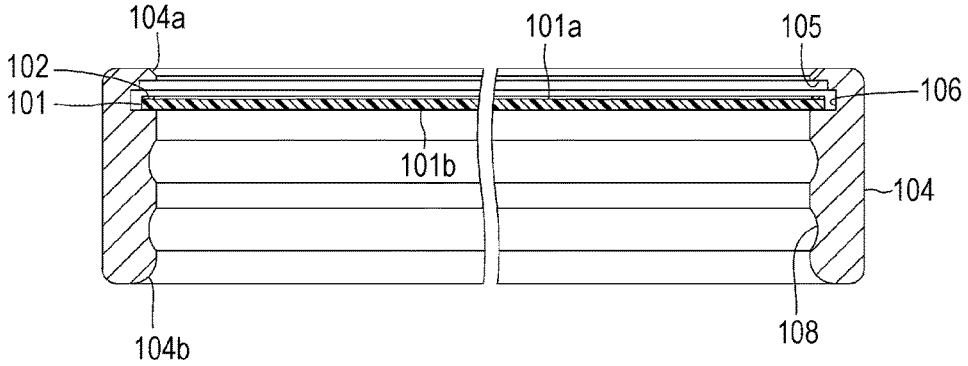
FIG. 10 is a cross-sectional view schematically illustrating another one process of the work process to mount the head to the frame in the manufacturing of the electronic percussion illustrated in FIG. 1.

Next, the worker mounts the head 101 to the frame 104. Specifically, while warping the head 101 as illustrated in FIGS. 9 and 10, the worker engages the entire head 101 with the inside of the second holding groove 106 of the frame 104 from the one end 104*a* side. In this case, the second holding groove 106 is formed so as to have the depth deeper than the depth of the first holding groove 105. This ensures restraining an amount of warp of the head 101 to be small when the head 101 is mounted to the frame 104.

Figure 11:
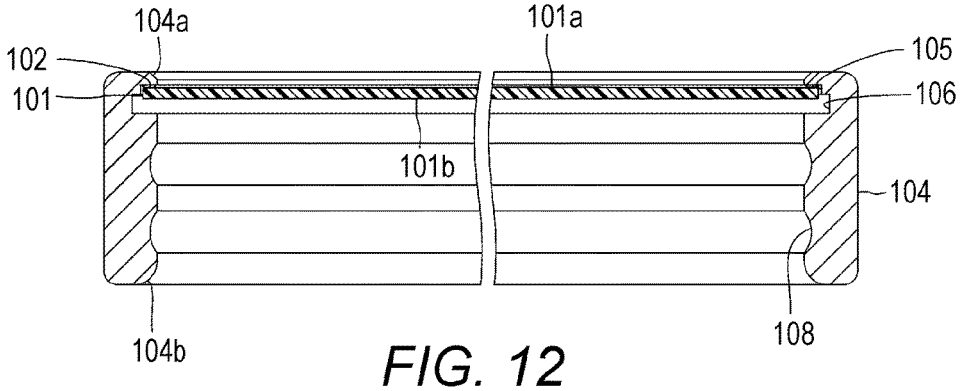
FIG. 11 is a cross-sectional view schematically illustrating another one process of the work process to mount the head to the frame in the manufacturing of the electronic percussion illustrated in FIG. 1.

Next, the worker moves the head 101 disposed in the second holding groove 106 to the inside of the first holding groove 105. Specifically, as illustrated in FIG. 11, the worker moves the head 101 disposed in the second holding groove 106 inside the second holding groove 106 to position the head 101 to a position facing the first holding groove 105. Afterwards, the worker moves the entire head 101 to the inside of the first holding groove 105. This allows the worker to move the head 101 to the inside of the first holding groove 105. In this case, the thickness (the groove width) of the first holding groove 105 is smaller than the plate thickness of the head 101. Therefore, the head 101 is disposed in the first holding groove 105 while the entire plate surface of the head 101 on the second holding groove 106 side projects out to the second holding groove 106 side.

Figure 12:
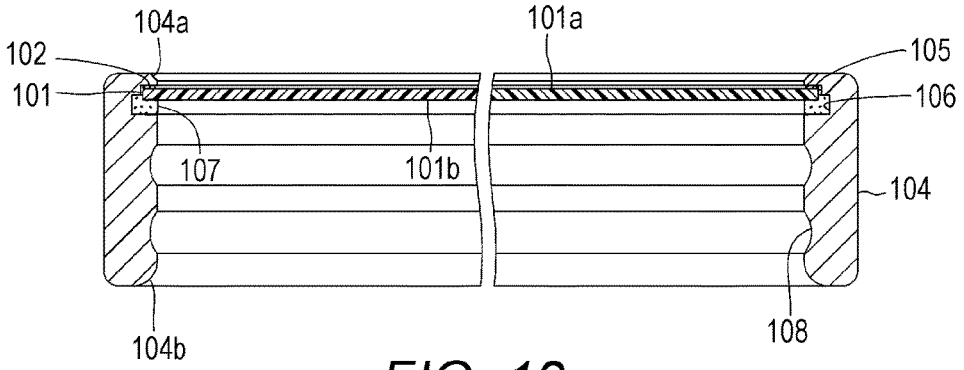
FIG. 12 is a cross-sectional view schematically illustrating another one process of the work process to mount the head to the frame in the manufacturing of the electronic percussion illustrated in FIG. 1.

Next, the worker fixes the head 101 to the inside of the first holding groove 105. Specifically, as illustrated in FIG. 12, the worker prepares the head fixing body 107 and packs the head fixing body 107 into the second holding groove 106. Accordingly, the head 101 squeezed by the head fixing body 107 is fixed to the inside of the first holding groove 105. FIGS. 8 to 12 omit the illustrations of the sound source support frame 110, the head 101, and the intermediate part of the frame 104.

Next, the worker mounts the other components constituting the electronic percussion 100 to the head 101 or the frame 104. Thus, the worker completes the electronic percussion 100. Specifically, the worker prepares the hitting sensor 103. Afterwards, the worker pastes the hitting sensor 103 to the center of the back surface 101*b* of the head 101 using the adhesive or the adhesive double coated tape. The worker prepares the sound source 111. Afterwards, the worker mounts the sound source 111 to the sound source support frames 110 using a fixture such as a screw. In this respect, the worker couples the signal line (not illustrated) of the hitting sensor 103 to the sound source 111. Thus, the worker can complete the electronic percussion 100.

(Use of Electronic Percussion 100)

The following describes the use of the electronic percussion 100 configured (manufactured) as described above. First, the player prepares the electronic percussion 100 and the external speaker (not illustrated). Afterwards, the player electrically connects the electronic percussion 100 to the external speaker via the output terminal 114. Next, the player powers ON the electronic percussion 100. Afterwards the player operates the operation switch 112 to set the sound source 111 in a performance mode in which the player can play the performance. Accordingly, the sound source 111 enters the state in which the sound source 111 detects the vibrations of the head 101 to output the musical sound.

Next, while gripping the electronic percussion 100 by one hand or holding the electronic percussion 100 to a stand, the player plays the performance by beating or rubbing the struck surface 101*a* of the head 101 by the hand. Thus, the head 101 of the electronic percussion 100 vibrates, warps, and deforms according to the performance operation by the player. In this respect, with the electronic percussion 100, the hitting sensor 103 detects the vibrations of the head 101 to output the detection signals according to the vibrations to the sound source 111. Thus, the sound source 111 creates the musical sound signals representing the musical sound based on the detection signals output from the hitting sensor 103 to output the musical sound to the external speaker.

Consequently, the electronic percussion 100 can output the musical sound according to the performance operation by the player from the external speaker. With this embodiment, the head 101 is held to the inside of the first holding groove 105 of the frame 104. This ensures restraining the drop of the head 101 from the inside of the first holding groove 105.

During the maintenance of the electronic percussion 100, the worker can remove the head 101 from the frame 104 by a procedure opposite to the procedure during the manufacturing. That is, the worker removes the sound source 111 from the sound source support frames 110. Afterwards, the worker removes the head fixing body 107 from the inside of the second holding groove 106 and moves the head 101 inside the first holding groove 105 to the inside of the second holding groove 106. Next, by warping the head 101 inside the second holding groove 106, the worker can take out the head 101 from the inside of the second holding groove 106. In this case, regardless of whether the hitting sensor 103 is attached to or removed from the head 101, the worker can remove the head 101 from the frame 104.

As can be understood from the above-described explanation of the operation, with the embodiment, the electronic percussion 100 includes the groove-shaped first holding groove 105 and the groove-shaped second holding groove 106 at the inner surface of the frame 104. The outer edge of the head 101 is inserted into the first holding groove 105. Accordingly, the first holding groove 105 holds the head 101. The second holding groove 106 is communicated with the first holding groove 105 and has the depth deeper than the depth of the first holding groove 105. Therefore, the head 101 having rigidity can be formed into the simple plate shape. Furthermore, this ensures easily mounting the head 101 to the first holding groove 105 via the second holding groove 106 or easily removing the head 101.

Furthermore, the aspects of this disclosure are not limited to the above-described embodiment. The embodiment can be variously changed as long as not departing from the object of the technique of this disclosure. Like reference numerals designate identical elements throughout the embodiment and the following modification, and therefore such elements will not be further elaborated here.

For example, with the embodiment, the hitting sensor 103 is configured to detect the vibrations of the head 101. However, the hitting sensor 103 may be configured such that at least one of the vibrations of the head 101 and a pressure change in the head 101 is detected. Accordingly, the hitting sensor 103 may include a pressure sensor instead of or in addition to a vibration sensor. That is, the hitting sensor 103 may be configured to detect at least one of the vibrations and the pressure generated by hitting the head 101 and to output the electrical signals. Furthermore, the hitting sensor 103 may be configured to detect at least one of the vibrations of the head 101 and the pressure applied to the head 101, which are generated by hitting the head 101, and to output the electrical signals.

With the embodiment, the head fixing body 107 is made of the elastic body. This allows the electronic percussion 100 to elastically support the head 101. Therefore, a feeling of hitting of the player can be made soft. Furthermore, the excessive vibrations can be restrained. Meanwhile, as long as the head fixing body 107 is disposed inside the second holding groove 106 and can fix the head 101 inside the first holding groove 105, the configuration is not necessarily limited to the embodiment. Accordingly, the head fixing body 107 can be made of a rigid body, more specifically, a material such as a hard resin material, wood, or a metal material.

With the embodiment, the head fixing body 107 has the length corresponding to the respective five sides of the frame 104 and is formed as the linearly extending string-shaped member. Meanwhile, the head fixing body 107 may be formed into the annular shape so as to correspond to the annular second holding groove 106. Alternatively, the head fixing body 107 may be formed as the linearly extending string-shaped member having the length corresponding to the overall length of the second holding groove 106.

With the embodiment, the head fixing body 107 is disposed inside the second holding groove 106. This allows the electronic percussion 100 to stably hold the head 101 inside the first holding groove 105. Furthermore, the head 101 can be easily taken out from the inside of the first holding groove 105. Meanwhile, the electronic percussion 100 may hold the head 101 inside the first holding groove 105 by a member other than the head fixing body 107. In this case, the head fixing body 107 can be omitted. For example, with the electronic percussion 100, the head 101 may be fixed to the inside of the first holding groove 105 with the adhesive or the adhesive double coated tape.

With the embodiment, the electronic percussion 100 includes the buffer 102 at the outer edge of the struck surface 101*a* of the head 101. Accordingly, the electronic percussion 100 restrains the direct contact of the outer edge of the head 101, which vibrates by hitting, to the inner wall surface of the first holding groove 105, thereby ensuring restraining the unusual sound between both. This buffer 102 may be pasted to the frame 104 side instead of the head 101. This configuration also can obtain the similar actions and effects. Thus, the buffer 102 made of the elastic body may be disposed between the head 101 and the frame 104 in the first holding groove 105. As long as the unusual sound generated between the head 101 and the first holding groove 105 does not cause a problem, the electronic percussion 100 may omit the buffer 102.

With the embodiment, the electronic percussion 100 includes the first holding groove 105 on the one end 104*a* side at the inner surface of the frame 104. Furthermore, the second holding groove 106 is formed with respect to the first holding groove 105 on the side opposite to the one end 104*a* side of the inner surface of the frame 104. Meanwhile, the first holding groove 105 can be disposed at the center in the height direction of the inner surface of the frame 104. The first holding groove 105 may be formed adjacent to at least one end among both ends of the inner surface of the frame 104. The second holding groove 106 can also be disposed between the one end 104*a* and the first holding groove 105.

With the embodiment, the one end 104*a* of the frame 104 facing the struck surface 101*a* of the head 101 is formed to decreases in thickness to the distal end (the inside of the frame 104). This allows the electronic percussion 100 to elastically support the outer edge of the head 101 vibrating by hitting by the end of the frame 104. Consequently, the unusual sound between the head 101 (the one end 104*a*) and the end of the frame 104 (the first holding groove 105) can be restrained. Meanwhile, the one end 104*a* of the frame 104 facing the struck surface 101*a* of the head 101 may be formed to have the constant thickness to the distal end (the inside of the frame 104). Accordingly, the electronic percussion 100 can strongly hold the outer edge of the head 101 vibrating by hitting.

Figure 13:
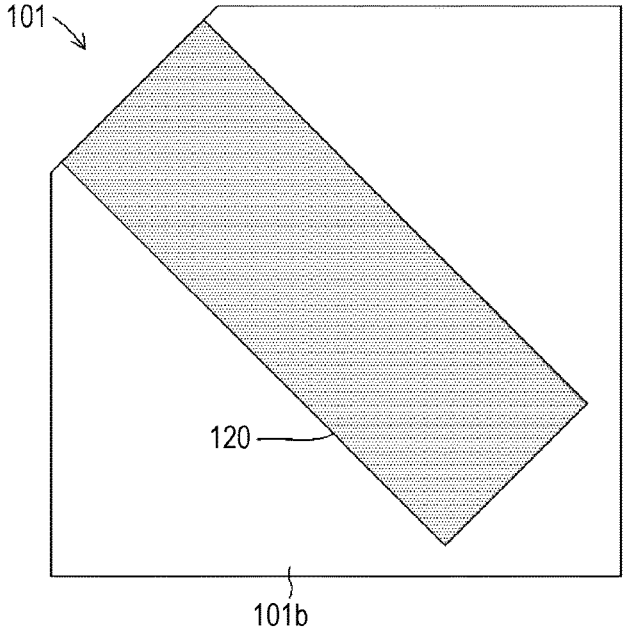
FIG. 13 is a bottom view illustrating an outline of an external configuration of a head according to a modification of this disclosure.

With the embodiment, the head 101 is made of the semitransparent resin material. Thus, with the head 101 made of the semitransparent or transparent material, the sound source 111 disposed on the back surface 101*b* of the head 101 side is possibly seen through via the semitransparent or transparent head 101 during the use of the electronic percussion 100. This possibly results in deterioration of fine appearance. Accordingly, in the case where the head 101 is made of the semitransparent or transparent material, as illustrated in FIG. 13, a mask 120 may be disposed at a position corresponding to the sound source 111 of the head 101.

The mask 120 is a component to restrain seeing the sound source 111, which is disposed on the back surface 101*b* side of the head 101, through the semitransparent or transparent head 101. The mask 120 is formed on the back surface 101*b* of the head 101. This mask 120 may be configured as a coated film formed by coating or printing (for example, silk-screen printing or ink-jet printing) to the back surface 101*b* of the head 101. Alternatively, the mask 120 may be configured as a sheet material pasted to the back surface 101*b* of the head 101. The mask 120 may have the size identical to the planar size of the sound source 111 to be hidden. More preferably, the mask 120 has the size slightly smaller than the planar size of the sound source 111. In the case where the mask 120 is formed by printing, a print density may become gradually light to the outer edge of the mask 120. Accordingly, the mask 120 can have an appearance like a natural shadow. The mask 120 may be formed at least one of the struck surface 101*a* and the back surface 101*b* of the head 101.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electronic percussion comprising:

a plate-shaped head constituting a struck surface beaten by a player;

a frame formed into an annular frame shape surrounding an outer edge of the head, the frame holding the head via the outer edge; and a hitting sensor configured to detect at least one of a vibration and a pressure generated by hitting of the head to output an electrical signal, wherein the frame includes:

a first holding groove formed into a groove shape at an inner surface of the frame, the outer edge of the head being engaged with the first holding groove such that the head is held; and a second holding groove formed into a groove shape at a position adjacent to and along the first holding groove such that the second holding groove communicates with the first holding groove, the second holding groove having a depth deeper than a depth of the first holding groove.

2. The electronic percussion according to claim 1, further comprising a head fixing body engaged with the second holding groove to press the outer edge of the head disposed inside the first holding groove.

3. The electronic percussion according to claim 2, wherein the first holding groove is formed to have a thickness thinner than a thickness of the outer edge of the head.

4. The electronic percussion according to claim 3, wherein the first holding groove is formed adjacent to at least one end among both ends of the inner surface of the frame, and the second holding groove is formed with respect to the first holding groove on a side opposite to the one end in the inner surface of the frame.

5. The electronic percussion according to claim 4, wherein the frame is formed such that the one end adjacent to the first holding groove decreases in thickness to an inside of the annular frame.

6. The electronic percussion according to claim 5, further comprising a buffer made of an elastic body disposed between the head and the frame in the first holding groove.

7. The electronic percussion according to claim 4, further comprising a buffer made of an elastic body disposed between the head and the frame in the first holding groove.

8. The electronic percussion according to claim 3, further comprising a buffer made of an elastic body disposed between the head and the frame in the first holding groove.

9. The electronic percussion according to claim 2, wherein the first holding groove is formed adjacent to at least one end among both ends of the inner surface of the frame, and the second holding groove is formed with respect to the first holding groove on a side opposite to the one end in the inner surface of the frame.

10. The electronic percussion according to claim 9, wherein the frame is formed such that the one end adjacent to the first holding groove decreases in thickness to an inside of the annular frame.

11. The electronic percussion according to claim 10, further comprising a buffer made of an elastic body disposed between the head and the frame in the first holding groove.

12. The electronic percussion according to claim 9, further comprising a buffer made of an elastic body disposed between the head and the frame in the first holding groove.

13. The electronic percussion according to claim 2, further comprising a buffer made of an elastic body disposed between the head and the frame in the first holding groove.

14. The electronic percussion according to claim 1, wherein the first holding groove is formed adjacent to at least one end among both ends of the inner surface of the frame, and the second holding groove is formed with respect to the first holding groove on a side opposite to the one end in the inner surface of the frame.

15. The electronic percussion according to claim 14, wherein the frame is formed such that the one end adjacent to the first holding groove decreases in thickness to an inside of the annular frame.

16. The electronic percussion according to claim 15, further comprising a buffer made of an elastic body disposed between the head and the frame in the first holding groove.

17. The electronic percussion according to claim 14, further comprising a buffer made of an elastic body disposed between the head and the frame in the first holding groove.

18. The electronic percussion according to claim 1, further comprising a buffer made of an elastic body disposed between the head and the frame in the first holding groove.

* * * * *